United States Patent [19]

Mack

[11] Patent Number: 4,780,911

[45] Date of Patent: Nov. 1, 1988

[54] DISPOSABLE BIB WITH ELASTICIZED HEAD OPENING

[75] Inventor: Robert J. Mack, Aberdeen, N.J.

[73] Assignee: Colgate-Palmolive Company, New York, N.Y.

[21] Appl. No.: 113,085

[22] Filed: Oct. 26, 1987

[51] Int. Cl.[4] ..... A41B 13/10

[52] U.S. Cl. ..... 2/49 R; 2/50

[58] Field of Search ..... 2/49 R, 48, 50, 51, 2/69

[56] References Cited

U.S. PATENT DOCUMENTS 2,620,475 12/1952 Legg et al. ..... 2/50

4,620,323 11/1986 Tepper ..... 2/49 R 4,706,303 11/1987 Van Gompel et al. ..... 2/49 R

*Primary Examiner*—Louis K. Rimrodt

*Assistant Examiner*—J. L. Olds

*Attorney, Agent, or Firm*—M. M. Grill; N. Blumenkopf

[57] ABSTRACT

A disposable bib comprising a sheet of waterproof material having a head opening, preferably of oval shape, therein. At least one elastic strip parallel to the longitudinal axis of the head opening is bonded to the sheet while in stretched condition closely proximate the head opening so that, when released, at least partial closure of the head opening is achieved, while causing a curvature of the bib to facilitate placement on the wearer. The head opening closely fits around the neck of the wearer.

3 Claims, 3 Drawing Sheets

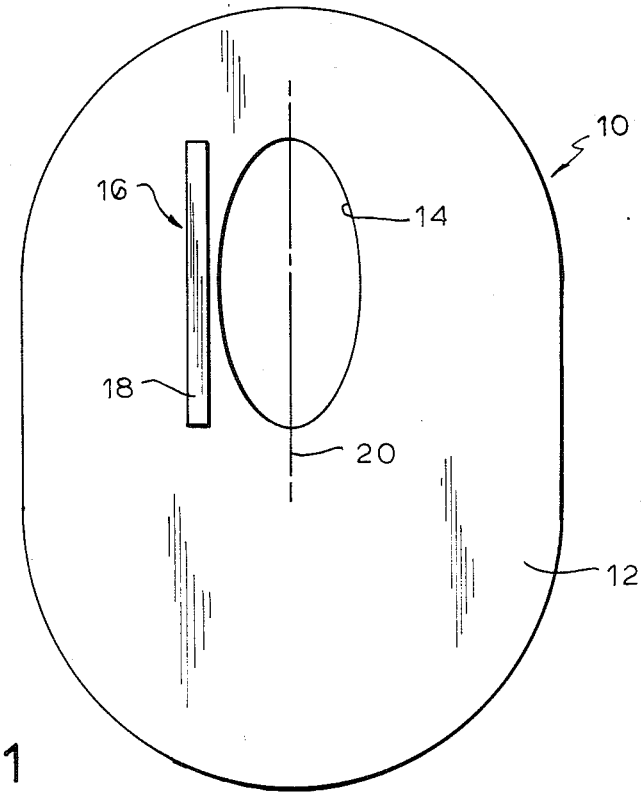
FIG. 1
FIG. 2
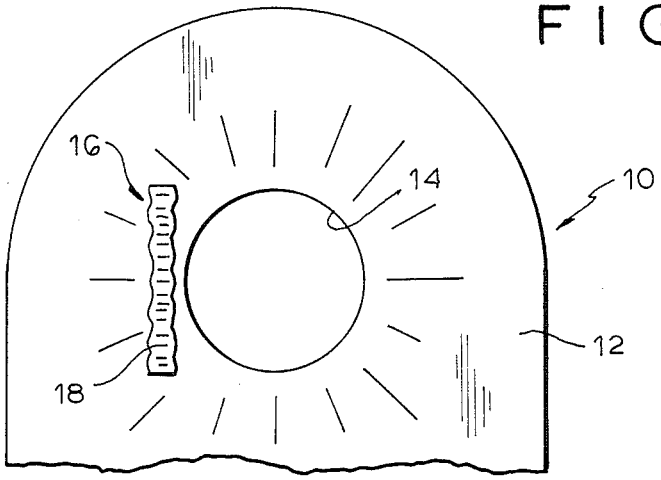

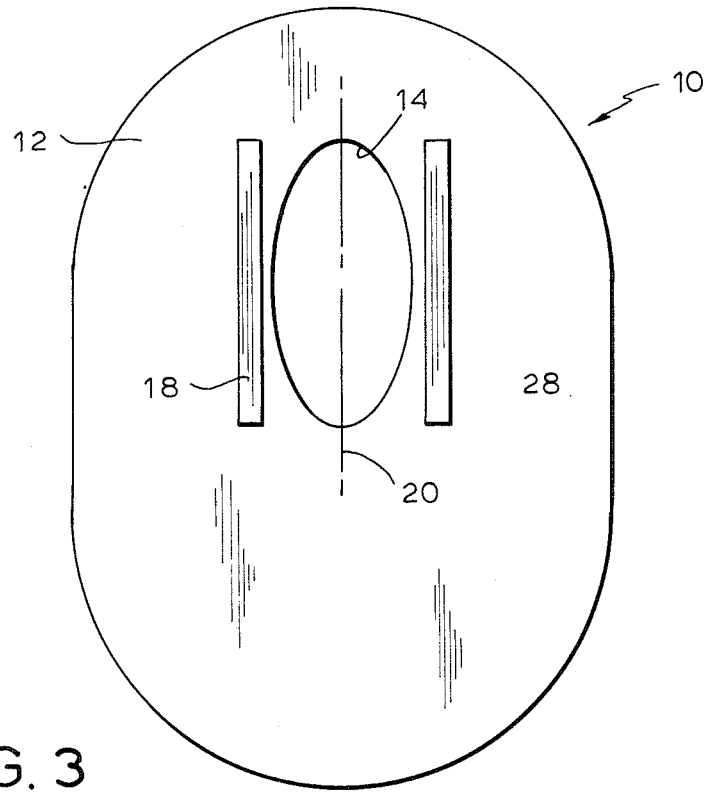
FIG. 3
FIG. 4
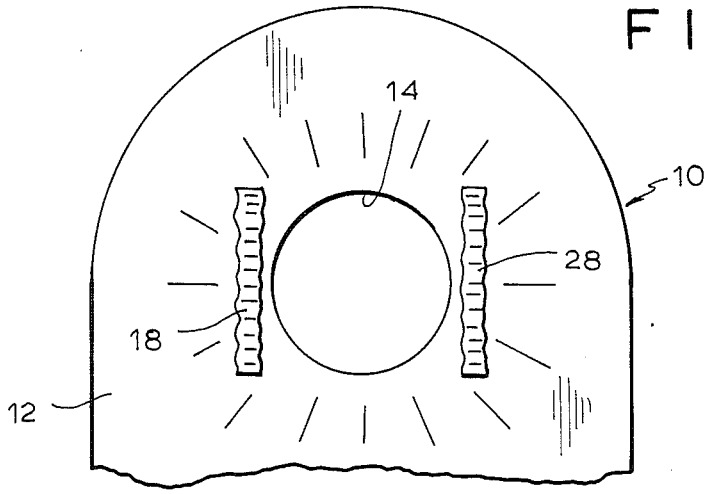

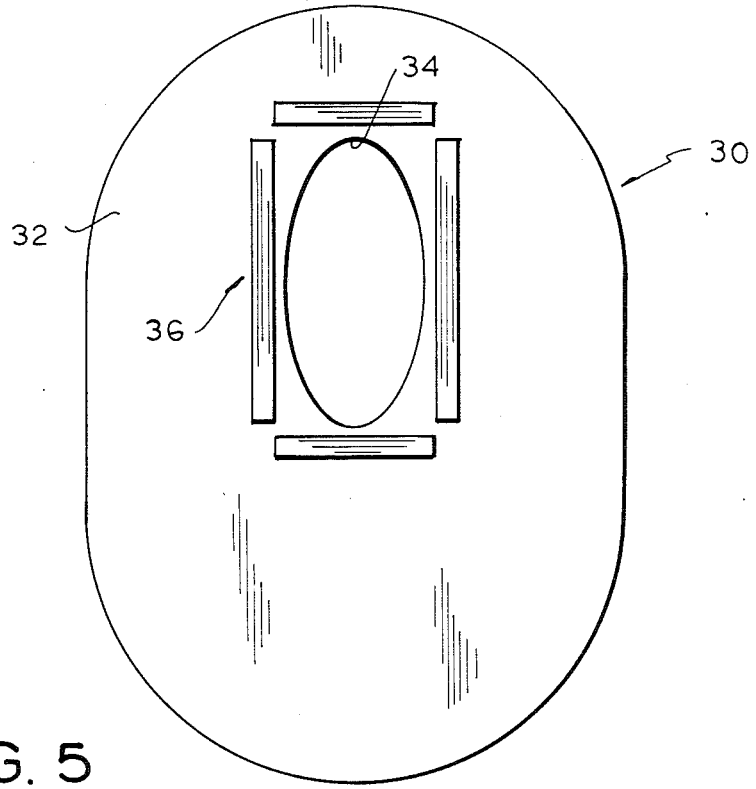
FIG. 5
FIG. 6
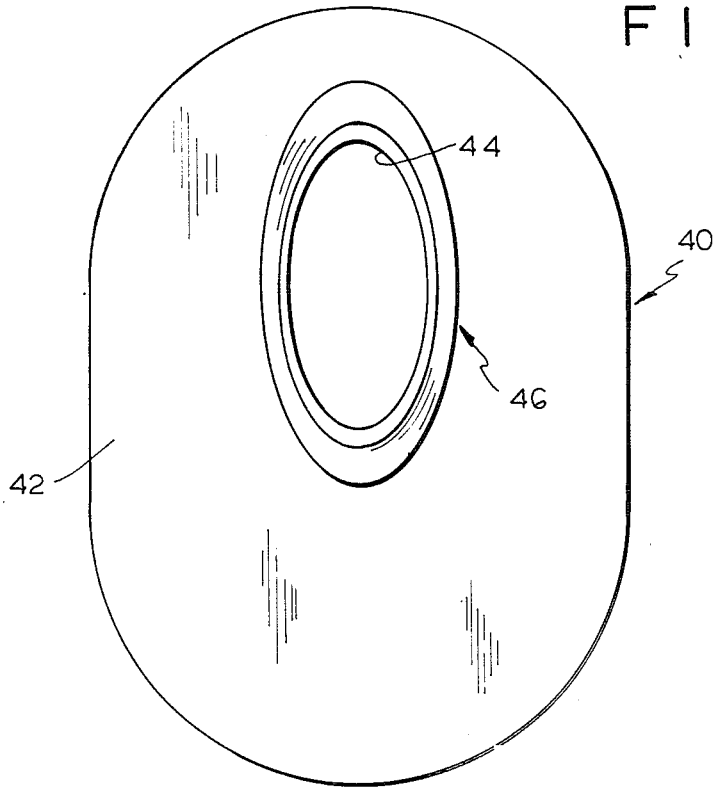

DISPOSABLE BIB WITH ELASTICIZED HEAD OPENING

BACKGROUND OF THE INVENTION

1. Field of the Invention

This invention relates to bibs for infants, children and adults and, more particularly, to a disposable bib having elastic means for providing for a better fit and additional protection.

2. Description of the Prior Art

Bibs have commonly been used on infants, young children, the ill or infirm when eating for the purpose of protecting the garments of the wearer. Disposable bibs of sheet plastic and paper have also been employed and many restaurants, when serving special foods, such as lobster, have made it a practice of providing a disposable bib to patrons.

In the past, the bibs have been provided with head openings so that the bib may be passed over the head of the wearer. These head openings had to be rather large to accommodate all size heads and allowed for spillage and soiling of the garments of the wearer between the nect and the lower part of the head opening when in place.

As an alternative, head openings were provided with contiguous slits so that the head opening could be relatively small and the opening expanded to accommodate a particularly large head. This had the disadvantage in that the bib could not releasably seat correctly and the garments of the wearer became exposed. Even the provision of strings would not assure proper, accommodating fit because they become tangled, knotted, etc. and the small size head opening with slits often caused discomfort to the wearer.

Various types of disposable bibs, such as those disclosed in U.S. Pat. Nos. 3,470,566 and 3,654,629 sought to overcome these disadvantages of prior disposable bibs.

OBJECTS OF THE INVENTION

The present invention has for its primary object to overcome the disadvantages of other disposable bibs by providing a bib with an elasticized head opening that will enhance garment protection, provide for better seating of the bib on the wearer, while adding to the comfort and assurance, as well as appearance, of the wearer.

SUMMARY OF THE INVENTION

A disposable bib is formed from a sheet of waterproof material having, preferably, an oval head opening. One or more strips of elastic material are bonded to the sheet adjacent the head opening and parallel to the longitudinal axis of the bib and head opening. In addition to a single elastic strip or a pair of parallel elastic strips, rectangular or oval elastic arrangements surrounding the head opening can be employed.

BRIEF DESCRIPTION OF THE DRAWINGS

FIG. 1 is a plan view of a bib with a single elastic member shown in stretched condition as applied;

FIG. 2 is a view, similar to FIG. 1, but showing the bib with the elastic in relaxed condition;

FIG. 3 is a plan view of a bib employing two parallel elastic strips shown in a stretched condition;

FIG. 4 is a view of the embodiment of FIG. 3, but shown in a relaxed condition;

FIG. 5 is a view of a modified form of the disposable bib showing a rectangular arrangement of elastic surrounding the head opening; and, FIG. 6 is a plan view of a yet further embodiment showing an oval arrangement of elastic in stretched condition.

DETAILED DESCRIPTION OF THE INVENTION

With continuing reference to the accompanying drawings, wherein like reference numerals designate similar parts throughout the various views, attention is initially directed to the embodiments of FIGS. 1 and 2 wherein a bib 10 according to the concept of the present invention is made from a sheet 12 of material.

The sheet 12 may be of a single ply of any suitable thickness and is of a waterproof material, such as an imperforate film of polyethylene or polypropylene. The sheet may be smooth given a suitable surface treatment of may be quilted. The sheet 12 may be of a single ply or have, in addition to the waterproof film, a cover or face sheet of non-woven or woven fabric. The non-woven material is preferred and may be of a hydrophobic substance, such as polyethylene, polypropylene, polyester or nylon fibers, which may be spun bonded. Various shapes for the bib 10 may be used, such as oval, rectangular or any suitable combination of shapes as desired.

The bib 10 is provided in its upper portions with a head opening 14, preferably oval in shape, and of such a size as to accommodate any likely user. Since it is desirable that the bib fit closely about the neck of the user to avoid any unprotected space, and, since the bib would hang from the back of the neck of the wearer, the present invention provided elastic means 16 in the form of a strip of elastic material 18, which is adhesively bonded, heat sealed or otherwise secured to the sheet 12 while in a stretched condition and in the direction of movement of the bib 10 during its manufacture.

The strip 18, when released as shown in FIG. 2, will cause the opening 14 to assume a substantially circular position capable to being adapted to an enlarged oval position to permit the bib to pass over the head of the wearer, but capable of then relaxing to pull the opening 14 to a circular smaller shape whereby the space open to permit soiling of garments is substantially reduced, if not eliminated entirely. The strip 18 may be of a prestretched heat shrinkable elastic as an alternative material.

The strip 18 is fixed in immediate close proximity to the opening 14 and extends parallel to the longitudinal axis 20 of the opening 14. The longitudinal axis 20 extends parallel to the direction of travel of the bib during manufacture and is also coincided with the longitudinal axis of the bib 10. It has been found that it is preferable that the strip 18 be placed within one-half inch of the opening 14 and, most preferably, one-quarter inch from the opening 14.

The strip 18 may be placed on either side of the opening 14. In FIGS. 3 and 4 there is shown an embodiment wherein a pair of strips 18 and 28 are provided. Each of the strips extends substantially the length of the opening 14 and is fixed to the sheet 12, preferably between one-half inch to one-quarter inch from the periphery of the head opening 14 at its periphery.

The two strips 18 and 28 serve to provide more elastic force than the single strip 18 and such an arrangement is employed dependent upon the material from which the sheet 12 is formed.

One of the great advantages of the strip 18 or the strips 18, 28 is that, when the strip 18 or strips 18 and 28 are released, they cause the sheet 12 to achieve an accurate configuration on either side of opening 14 so that the bib 10 seats easily on the shoulders of the wearer and is unlikely to hang to one side or the other of the wearer as in the case of no elastic strip being employed.

FIG. 5 depicts a bib 30 formed of a sheet 32 of waterproof material provided with a head opening 34. Elastic means 36 in the form of rectangularly arranged elastic strip material is disposed closely proximate the head opening 34 for constraining the head opening to a similar size when the elastic strip material is relaxed.

Referring now to FIG. 6, herein there is depicted a bib 40 of sheet material 42 provided with a head opening 44. Surrounding the head opening 44 and immediately proximate thereto is elastic means 46 in the form of an oval arrangement of elastic strip material, which constrains the head opening 44 to a reduced size.

What is claimed is:

1. A disposable bib comprising a sheet of material for covering a portion of the torso of the wearer, said sheet having a head opening for passing the bib over the head of the wearer, and elastic means adjacent said head opening for reducing the head opening in size so that said bib fits substantially snugly about the neck of the wearer, said head opening being oval in shape, the longer axis of said oval head opening being the longitudinal axis of said opening and extending longitudinally of said bib, said elastic means comprising at least one elastic strip arranged parallel to said longitudinal axis of said head opening, said elastic strip causing a curvature of said bid to overlie the shoulders of the wearer.

2. A disposable bib according to claim 1 wherein said elastic means includes a pair of parallel elastic strips, said strips being disposed on each side of said head opening.

3. A disposable bib according to claim 1 wherein said elastic means is a pre-stretched heat shrinkable material.

* * * * *